US012024882B2

(12) United States Patent
Griffith et al.

(10) Patent No.: US 12,024,882 B2
(45) Date of Patent: Jul. 2, 2024

(54) STRUCTURAL BARRIER AND RELATED METHOD OF USE

(71) Applicant: Bohning Company, Ltd., Lake City, MI (US)

(72) Inventors: Larry R. Griffith, Lake City, MI (US); Robert L. Potter, McBain, MI (US)

(73) Assignee: Bohning Company, Ltd., Lake City, MI (US)

( * ) Notice: Subject to any disclaimer, the term of this patent is extended or adjusted under 35 U.S.C. 154(b) by 335 days.

(21) Appl. No.: 17/592,882

(22) Filed: Feb. 4, 2022

(65) Prior Publication Data

US 2022/0154456 A1 May 19, 2022

Related U.S. Application Data

(63) Continuation-in-part of application No. 29/737,942, filed on Jun. 12, 2020, now Pat. No. Des. 946,785,
(Continued)

(51) Int. Cl.
*E04B 1/94* (2006.01)
*E04B 1/68* (2006.01)
(Continued)

(52) U.S. Cl.
CPC ..... *E04B 1/948* (2013.01); *E04B 1/6801* (2013.01); *E04B 1/94* (2013.01); *E04B 1/944* (2013.01);
(Continued)

(58) Field of Classification Search
CPC . E04B 1/94; E04B 1/944; E04B 1/947; E04B 1/948; E04B 1/6801; E04B 1/6812;
(Continued)

(56) References Cited

U.S. PATENT DOCUMENTS 3,523,493 A 8/1970 Berry et al.
3,653,305 A 4/1972 Trieste et al.
(Continued)

FOREIGN PATENT DOCUMENTS

EP 3584381 12/2019
JP 2012225082 A 11/2012
WO 9626332 A1 8/1996

OTHER PUBLICATIONS https://rectorseal.com/blaze-foam-intumescent-compressible-firestop-foam/, downloaded Dec. 28, 2021.
(Continued)

*Primary Examiner* — Paola Agudelo
(74) *Attorney, Agent, or Firm* — Warner Norcross + Judd LLP

(57) ABSTRACT

An elongated structural barrier is provided including a base, a first panel extending upward from the base, a first sealer wall extending downward and transversely to the base, a second panel joined with the first panel and extending upwardly, a lower wedge extending upward from the base adjacent the first sealer wall, and a core compartment bounded by the lower wedge and the panels, with an open face defined above the lower wedge and offering a view into the core compartment. The lower wedge can include a flange to produce a first cavity of the compartment, in which an intumescent core can be positioned and configured to expand into a second cavity of the compartment when it swells. A second flange can oppose the first flange to further secure the core in the first cavity, and can form a bloom gap therebetween. A related method of use also is provided.

19 Claims, 9 Drawing Sheets

Related U.S. Application Data and a continuation-in-part of application No. 16/900,358, filed on Jun. 12, 2020, now Pat. No. 11,306,476.

(60) Provisional application No. 62/964,263, filed on Jan. 22, 2020.

(51) Int. Cl.
*E04B 2/56* (2006.01)
*E04B 2/74* (2006.01)

(52) U.S. Cl.
CPC ..... *E04B 1/947* (2013.01); *E04B 2/56* (2013.01); *E04B 2/7411* (2013.01); *E04B 2/7457* (2013.01); *E04B 2002/7481* (2013.01)

(58) Field of Classification Search
CPC ..... E04B 2/56; E04B 2/7411; E04B 2/7457; E04B 2002/7481
USPC ..... 52/404.1
See application file for complete search history.

(56) References Cited

U.S. PATENT DOCUMENTS 3,919,820 A 11/1975 Green
3,950,912 A 4/1976 Lundberg et al.
4,067,660 A 1/1978 Puccio
4,128,358 A 12/1978 Compton
4,141,189 A 2/1979 Borieson
4,447,172 A 5/1984 Galbreath
4,615,161 A 10/1986 Mileham
4,746,129 A 5/1988 Puccio
4,977,719 A * 12/1990 LaRoche ..... E04B 1/6815 52/396.01
5,035,533 A 7/1991 Brown
5,502,937 A * 4/1996 Wilson ..... B32B 15/20 52/273
D432,671 S * 10/2000 Grosfillex ..... D25/119
7,240,905 B1 7/2007 Stahl, Sr.
D573,267 S 7/2008 Brinton et al.
D573,268 S 7/2008 Lundsgaard et al.
7,513,082 B2 4/2009 Johnson
8,375,666 B2 2/2013 Stahl, Jr. et al.
8,671,632 B2 3/2014 Pilz et al.
9,435,114 B1 9/2016 Preston
D769,461 S 10/2016 Mumford, Sr.
D774,213 S 12/2016 Baldoni et al.
10,246,871 B2 4/2019 Pilz
D855,702 S * 8/2019 Garfinkle ..... D20/43
10,851,542 B2 12/2020 Hensley et al.
11,111,666 B2 9/2021 Pilz
2006/0032163 A1* 2/2006 Korn ..... E04B 1/68 52/241
2008/0263980 A1 10/2008 Shaw
2011/0011019 A1* 1/2011 Stahl, Jr. ..... E04B 2/7411 52/309.1
2016/0017598 A1* 1/2016 Klein ..... E04B 2/7411 52/232
2016/0017599 A1* 1/2016 Klein ..... E04B 2/7411 52/717.03
2017/0145685 A1* 5/2017 Andresen ..... E04B 2/96
2017/0234004 A1 8/2017 Pilz
2018/0030724 A1* 2/2018 Schulz-Hanke ..... E04B 2/88
2018/0334799 A1* 11/2018 Andresen ..... E04B 1/7675
2019/0376300 A1* 12/2019 Förg ..... E04B 1/88
2019/0383003 A1* 12/2019 Stahl, Jr. ..... E04B 2/7411

OTHER PUBLICATIONS https://www.hilti.com/c/CLS_FIRESTOP_PROTECTION_7131/CLS_PREFABRICATED_JOINTS_7131/r5044710, downloaded Dec. 28, 2021.
https://www.clarkdietrich.com/products/ultrabead-fire-smoke-sound, downloaded Dec. 28, 2021.

* cited by examiner

STRUCTURAL BARRIER AND RELATED METHOD OF USE

BACKGROUND OF THE INVENTION

The present invention relates to a structural barrier, and more particularly to a structural barrier that is disposed between adjacent structures to inhibit the spread of sound, fire, smoke and other things through a gap between the adjacent structures.

In the construction of buildings, walls typically extend between a floor and a ceiling in a room or other space. In many construction projects, where a wall, floor or ceiling abuts another wall, floor or ceiling, a joint or gap sometimes is created. This is many times the case in commercial construction, where a building shell or a number of structural floors are first constructed. After construction of the shell or floors, walls are built to subdivide the shell or each floor into multiple rooms. The walls typically include a bottom plate that is fastened to the floor. The walls extend upward toward a ceiling. The walls also include a top plate or top that is placed close to the ceiling. To facilitate raising or tilting of a built wall into place under the ceiling, walls are constructed slightly shorter than the distance between the floor and ceiling so that the top plate does not engage the ceiling as a wall is raised to a vertical configuration.

Due to the shortness of the walls relative to the distance between the floor and ceiling, an opening is produced above the wall, below the ceiling. Most fire and other building codes require this opening to be filled with a fire retardant, fireproof and/or sound deadening material. Frequently, these materials are applied in liquid, semi-liquid or sprayed foam form. An installer usually manipulates a large applicator tube or caulk gun filled with a tube of the material, and aims a nozzle into the opening. The installer activates the tube or gun to squirt or spray a bead or amount of the material into the opening as the installer advances along the opening. The installer must perfectly time and move the nozzle at a constant rate to ensure the bead is of a uniform size so material is not wasted, and so enough material fills the opening to seal it between the wall and ceiling.

In most cases, the materials are applied with a large tube or caulk gun, as mentioned above. These applicators are large, bulky and unwieldy, particularly when the installer installs the material in an opening overhead, along a very long wall, or along multiple walls for multiple times during a workday. Further, after the materials set, the excess applied material must be removed to provide a finished appearance of the filler and adjacent walls. For example, the material may need to be cut and sometimes sanded away to smooth it flush with the adjacent wall or ceiling so that wall coverings or flooring can be applied. In addition, when the material is hand applied and is semi-flowable upon application, the material often drips or runs down walls. It also can coat or otherwise fill gaps intended for wiring, plumbing and/or HVAC ducting. This can create a lot of extra work to remove the extra material.

Accordingly, there remains room for improvement in the field of fillers to seal or fill the openings between adjacent walls, ceilings or panels in construction projects.

SUMMARY OF THE INVENTION

An elongated structural barrier is provided including a base, a first panel extending upward from the base, a first sealer wall extending downward and transversely to the base, a second panel joined with the first panel and extending upwardly, a lower wedge extending upward from the base adjacent the first sealer wall, and a core compartment bounded by the lower wedge and the panels, with an open face defined above the lower wedge and offering a view into the core compartment. The elongated structural barrier can be easily and precisely installed between a variety of building structures to automatically seal a respective gap therebetween.

In one embodiment, the barrier can include an upper wedge extending downward from a wiper end of the second panel toward the lower wedge. The upper wedge and the lower wedge can cooperatively define the open face.

In another embodiment, an elongated core can be disposed in the compartment. The core can be of elongated construction and extends along a length of the base. The core can include an exposed surface that is exposed to a viewer through the open face.

In still another embodiment, the core can be constructed from an intumescent material that swells due to exposure to heat against the lower wedge and the optional upper wedge. These wedges can cooperatively retain the core within the core compartment when the core swells. For example, in some cases, the upper wedge and the lower wedge can exert opposing forces on the core when it expands under heat to retain the core in the compartment.

In yet another embodiment, the second panel extends upwardly along a curvilinear contour. This curvilinear contour can include a radius of about 0.2 inches to about 0.6 inches. This curvilinear contour can be convex upwardly, away from a horizontal reference line that bisects the core compartment into upper and lower portions. This curvilinear contour and the second panel in general can be flexible, so as to automatically adjust to varying dimensions of a gap in which the barrier is placed. As a result, this can increase the range of the gap minimum and maximum fitment.

In even another embodiment, the barrier can include a transition wall that extends vertically and transversely to the horizontal reference plane. The transition wall can join the first panel and the second panel. In some cases, the transition wall can be planar, while both the first panel and the second panel can be curvilinear, and convex away from the horizontal reference plane.

In yet a further embodiment, the core in the core compartment can be constructed from a fire retardant, fire proof and/or sound deadening material to further enhance the isolation functionality of the structural barrier placed in a gap.

In another embodiment, the barrier can include a lower first flange extending from the first wedge. The core compartment can include a first cavity and a second cavity. The lower wedge can include a lower first flange extending toward the first panel. The first cavity can be below the lower first flange. The second cavity can be above the lower first flange.

In still another embodiment, the barrier can include a lower second flange joined with the first panel and extending toward the lower wedge. The first cavity can be below the lower second flange. The second cavity can be above the lower second flange.

In yet another embodiment, the core can be constructed from an intumescent material that swells due to exposure to heat against the lower first flange and the lower second flange. The lower first flange and the lower second flange can define a bloom gap therebetween. The intumescent material can swell through the gap and into the second cavity of the core compartment when the core swells.

In a further embodiment, a method of installing an elongated structural barrier is provided. The method can include placing an elongated structural barrier in a gap between a first surface and a second surface of a building such that a first panel and a second panel are within the gap, with the first panel engaging the first surface and the second panel engaging the second surface above the first surface, and such that a base extends away from the first panel; placing a first sealer wall extending downward and transversely from the base against a third surface of the building that is substantially perpendicular to the first surface, with the first sealer wall at least impairing the first and second panels from being inserted too far into the gap between the first and second surfaces; moving the second panel downward toward the base, with the second panel bending along an arcuate contour toward the base, so that a height of the barrier automatically adjusts to allow the barrier to fit within the gap between the first surface and the second surface; and optionally applying a wall covering to the first sealer wall so that the first sealer wall melds into the third surface.

In another embodiment, the method can be used where the first surface is an upper portion of a vertical wall, where the second surface is a horizontal surface above the vertical wall, spaced from the upper portion of the vertical wall by the gap, and where the third surface is a vertical surface of the vertical wall. The applying step can include applying a material over a lower edge of the first sealer wall and over the vertical surface.

In still another embodiment, the method can include compressing an intumescent core within the core compartment. The intumescent core can be retained within the core compartment via forces exerted by the respective first wedge and the second wedge against the core. In some applications, the core can be visible though the open face upon installation of the barrier within the gap.

The current embodiments of the structural barrier and related method of installation provide benefits in sealing or filling gaps between adjacent building structures that previously have been unachievable. For example, the elongated structural barrier can be rapidly installed within gaps overhead, down low, or in difficult to reach locations in a building. Where the second panel is arcuate and flexible, the elongated structural barrier can compress or expand within a gap and automatically and adequately seal against the adjacent surfaces, regardless of varying dimensions of the gap therebetween. Where the lower and/or upper wedges are included, these components can retain the core in the core compartment for a longer period of time to enhance fire protection. The core can expand, but the wedges can exert opposing forces on the core to prevent it from ballooning out of the core compartment and/or the barrier.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
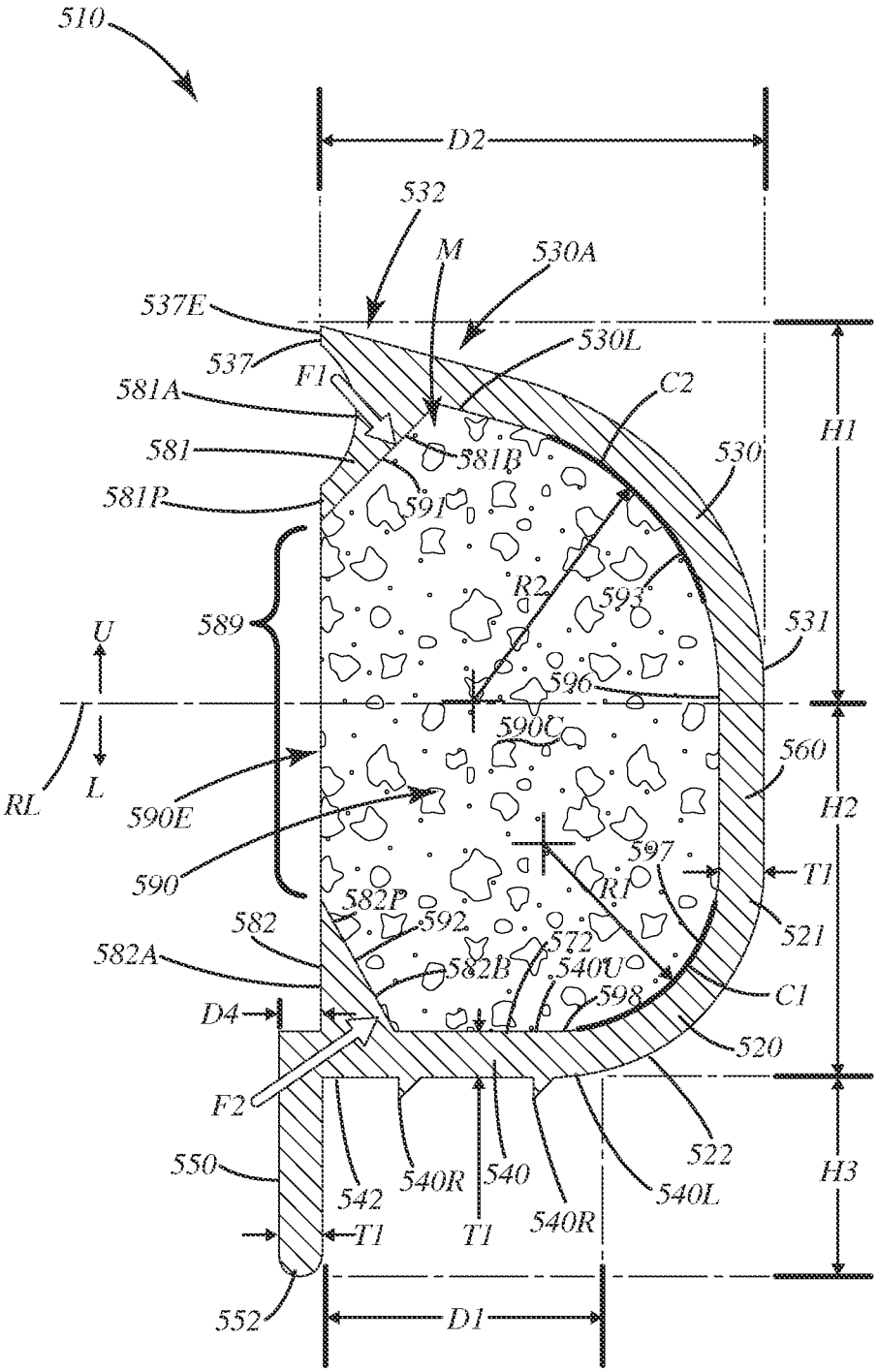
FIG. 1 is a section view of the structural barrier of a current embodiment.
Figure 2:
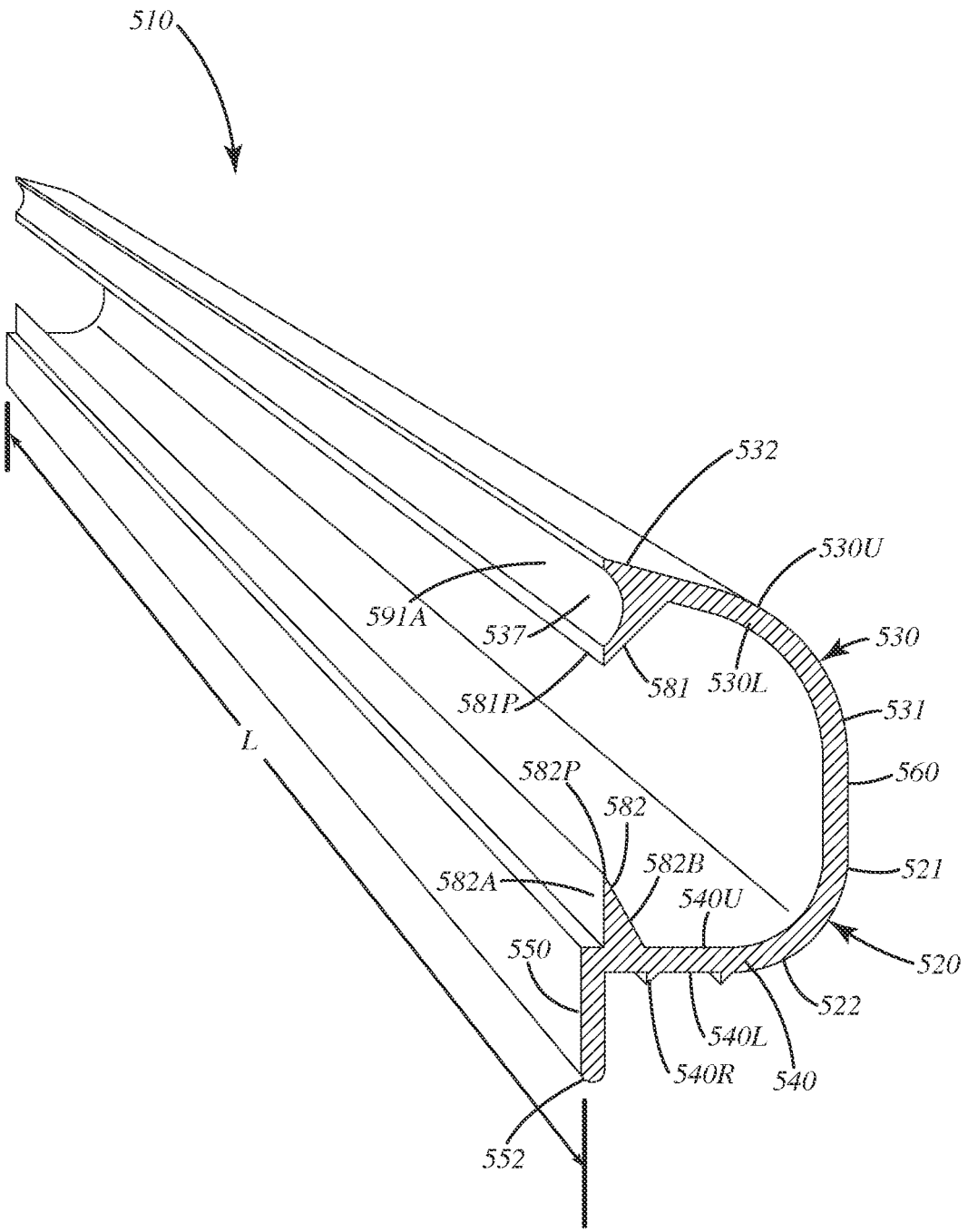
FIG. 2 is a perspective view of the structural barrier, without a core installed therein.

A current embodiment of the structural barrier is illustrated in FIGS. 1-5, and generally designated 510. The structural barrier can be in the form of an elongated structure. As shown in FIG. 2, this elongated structure can have a length L. This length L can be of any predetermined length suitable for fitting between adjacent building structures, such as walls, ceilings, floors, roofs, etc. The predetermined length L can be optionally at least 1 foot, at least 2 feet, at least 3 feet, at least 4 feet, at least 6 feet or greater or lesser lengths, depending on the application and the length of the gap to be filled in, sealed or otherwise closed. The structural barrier 510 can include a first panel 520 and a second panel 530. The first panel 520 and second panel 530 can be joined via a transition wall 560. The first panel 520 can extend to a base or extension wall 540 which itself can transition to a first sealer wall 550. The second panel 530, which is shown disposed above the first panel 520, transition wall 560, extension wall 540 and first sealer wall 550, can terminate at a wiper end 537. This wiper end 537 can be closer to the transition wall 560 than the first sealer wall 550, and can be configured to move in direction M such as when the barrier 510 is forced into a gap between structural members, optionally under force.

The barrier 510 can be equipped with one or more wedges, such as a first or upper wedge 581 that projects from the second panel 530 at or near the wiper end 537, distal from the transition wall 560, and/or a second or lower wedge 582 that projects from the base 540 at or near the first sealer wall 550. The wedges 581 and 582 can define therebetween an open face 589, through which a fire resistant core 590 is visible to confirm via a visible inspection its presence in the barrier 510. The open face design with the core also allows the first wedge 581 to flex toward the second wedge 582 when the core compresses under forces as described below, which in turn allows for significant variance in gap widths in which the barrier can be used. Further, the first and second wedges 581, 582 can function to contain and restrain the core as the core 590 expands under elevated temperatures as described below. In some cases, the wedges redirect pressure from the expanding core to increase the retention force of the core within the barrier as described below.

Figure 4:
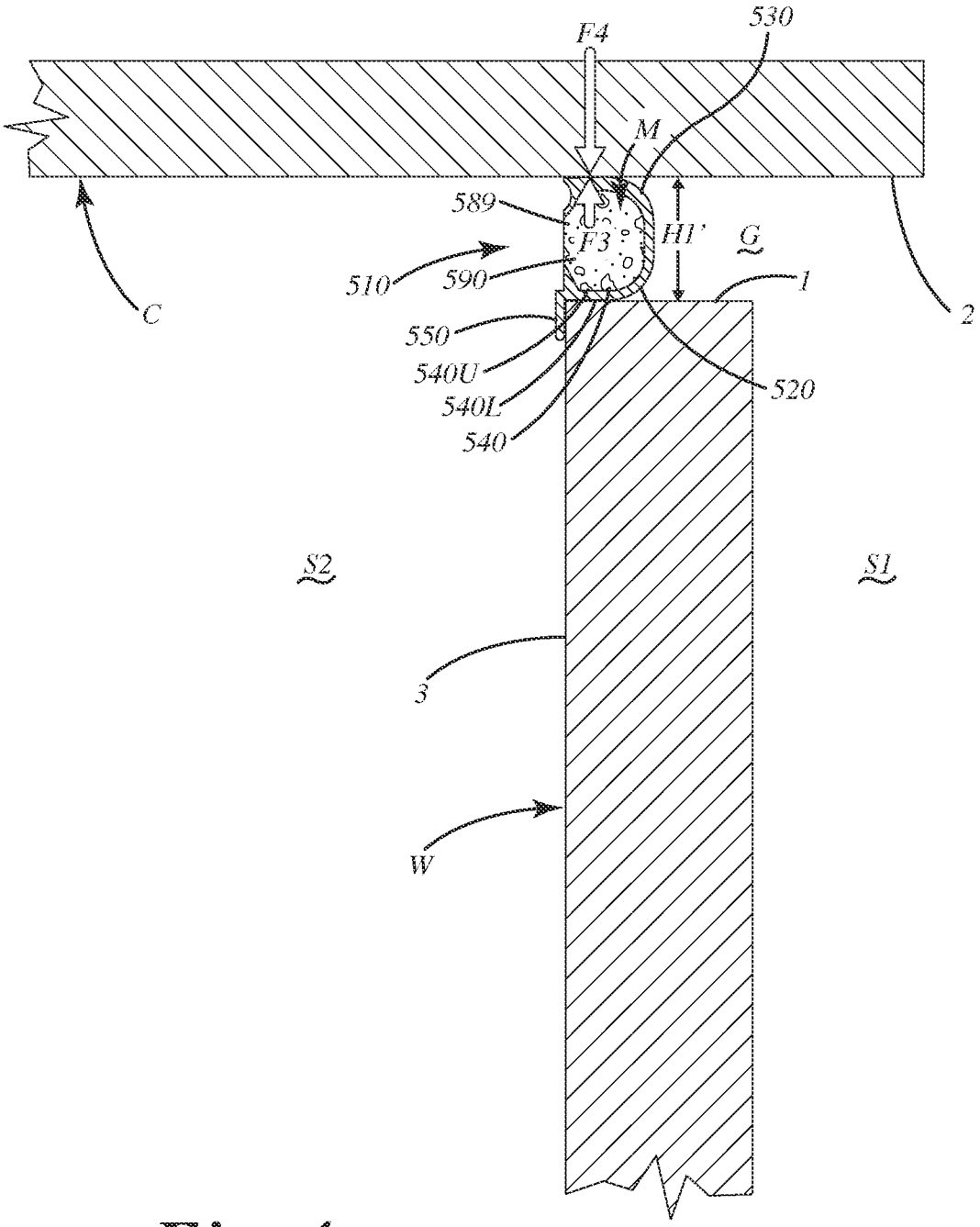
FIG. 4 is a section view of the structural barrier installed in the gap.
Figure 5:
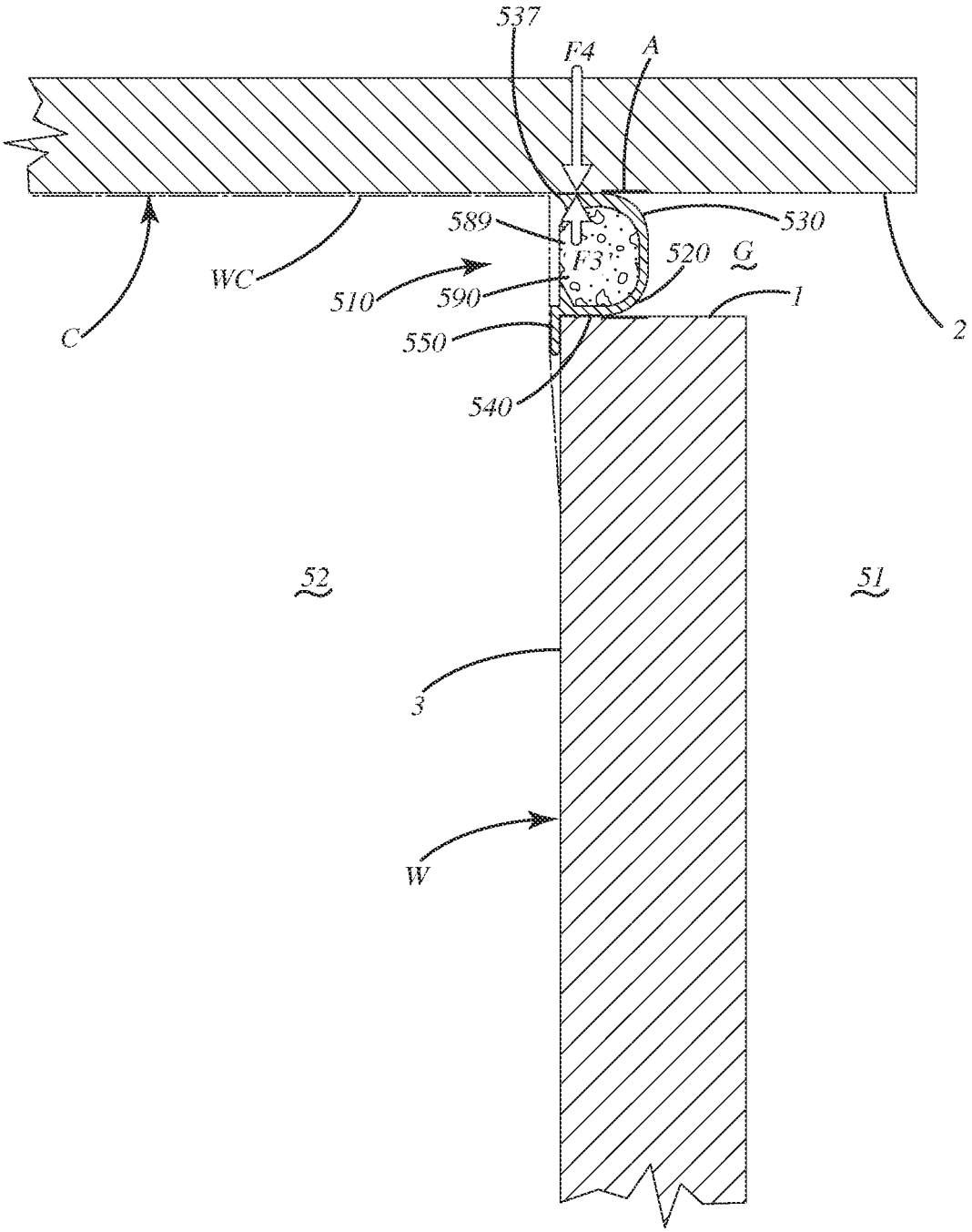
FIG. 5 is a section view of the structural barrier being sealed and covered partially with a wall covering.

As shown in FIGS. 4-5, the structural barrier 510 can be disposed between a first building surface 1 and a second building surface 2 to fill in, occlude, or partially or fully obstruct a gap G between the first surface 1 and the second surface 2. As shown, the first surface 1 can be an upper portion of a wall W, and the second building surface 2 can be a horizontal surface, such as that of a ceiling or a roof or other generally horizontal structure C in a building. Of course, in other applications as described below, the gap G can be formed between other building surfaces.

The structural barrier 510 can be constructed from a variety of materials such as polymers, composites, metals and combinations thereof. In the embodiment illustrated, the structural barrier can be an extruded piece of polymeric material. This polymeric material can be a fire resistant or fire retardant thermoplastic urethane (TPU). Of course, other types of polymeric materials can be used. These polymeric materials can be resistant to fire and/or thermal degradation or generally can burn at very slow rates. These polymeric materials can include polar monomers and/or hydrogen bonding between polymer chains to enhance fire resistance. The polymers optionally can incorporate aromatic cycles or heterocycles, polyimides, polybenzoxazoles, polybenzimidazoles, and polybenzthiazoles are some examples of polymers suitable for the structural barrier. The polymeric material can be a ladder polymer, which links to polymer chains with periodic covalent bonds, or can be a single chain that is double-stranded. Further optionally, the polymeric material can include an inorganic and/or semi-organic polymer having silicon-nitrogen, boron-nitrogen and/or phosphorus-nitrogen monomers. Further optionally, the polymeric material can include a flame retardant additive and/or filler. Examples of such an additive can include aluminum, phosphorus, nitrogen, antimony, chlorine, bromine, and in some cases magnesium, zinc and/or carbon. In some cases, where the structural barrier is constructed from a composite, that composite can include natural fibers that are fire retardant. In other cases, the structural barrier can be constructed from nano composites, carbon fibers and other carbon-based materials. In yet other cases, organic modified clays, titanium dioxide, nanoparticles, silica nanoparticles, layered double hydroxides, carbon nanotubes and polyhedral silsesquioxanes can be incorporated into and/or form the structural barrier.

Optionally, the structural barrier can be constructed via extrusion. This can enable the structural barrier to be produced in elongated form and in a continuous, repeatable manner. Such extrusion also can facilitate manufacture of long pieces of the structural barrier, which optionally can be cut to custom or standard lengths for a particular job. These long pieces of structural barrier also can be rolled into rolls where the structural barrier material is flexible. Of course, in other applications, the elongated structural barrier can be constructed via injection molding, and pour molding with other techniques.

With further reference to FIGS. 1-2, the structural barrier 510 can include a first panel 520, a second panel 530 and a base 540. The base 540 can be a planar strip or sheet, and can extend from the first sealer wall or panel 550 to the first panel 520. The base 540 can extend the length L of the barrier 510. The base can include an upper surface 540U and an opposing lower surface 540L. The upper surface can be flat and featureless, and configured to face and engage the core 590 as described below. The lower surface can likewise be flat and featureless, however, in some cases, the lower surface can include ribs 540R. These ribs can be elongated, and can extend the length L of the barrier. The ribs can be of a polygonal shape, or other shapes such as rounded, contoured or other shapes. The ribs can engage and bite into drywall or other wall structures under the barrier 510 when installed. This can provide enhanced retention capability to hold the barrier in the gap G within which it is placed. The upper surface can be void of ribs, as it typically only engages the core 590.

As mentioned above, the base 540 can extend between the sealer wall 550 and the first panel 520. The base can include a second or lower wedge 582 projecting therefrom. As shown, the wedge projects upwardly from the upper surface 540U of the base 540 at, near or adjacent the sealer wall 550. The wedge can be a true wedge, with first 582A and second 582B walls tapering toward one another toward an apex 582P, or a thick flange having a uniform thickness extending upward from the base. The wedge wall 582B can face toward the first panel 520 and/or the second panel 530 when the wedge is in its static condition shown in FIGS. 1 and 2. The lower wedge can be set back a distance D4 from the outer or exterior surface of the first sealer wall 550. This distance can be equal to or greater than the thickness of the first sealer wall 550, depending on the application.

The first sealer wall 550 can be joined with the distal end 542 of the base 540. The first sealer wall 550 can extend generally perpendicular to the first extension wall 540 and downward, away from the horizontal reference line RL, which can bisect the core compartment 590C generally into upper U and lower L parts. The reference line RL also can correspond to a reference plane through which the reference line extends along the length L of the structural barrier 510. As mentioned above, the first sealer wall 550 can be of a planar or flat shape as shown, extending downward, away from the reference line RL or plane and the first extension wall or base 540. The first sealer wall 550 can extend downward from the base 540 by a distance H3. This distance H3 can be less than the overall height H1 plus H2 of the barrier 510 above the sealer wall 550, and optionally less than each of the heights H1 or H2 of the upper U and lower L parts of the core compartment or barrier itself. In some cases, the height H3 can be optionally 0.25 inches to 2.00 inches, inclusive, 0.5 inches to 1.5 inches inclusive, 0.75 inches to 1.25 inches, 0.5 inches to 1.00 inches, inclusive, about 1.00 inches, or other heights, depending on the application and the amount of overlap of an adjacent building surface 3, for example, a vertical surface of a wall W. Although shown as flat or planar, the first sealer wall 550 can be arcuate, and/or can include a curvature. The sealer wall 550 can be somewhat rigid and inflexible, to assist in placement of the barrier in the gap G as described below. In other cases, the wall 550 can be resilient and can bend when the distal end 552 engages a third surface 3, which can be substantially perpendicular to the first surface 1 as shown in FIG. 4. As shown, the first sealer wall 550 can at least impair the first 520 and second 530 panels from being inserted too far into the gap G between the first 1 and second 2 surfaces.

Optionally, the distal end 552 can be thinned to a second thickness that is less than the first thickness T1. The second thickness can be very thin so that the structure at the distal end 552 melds into and cleanly transitions to an adjacent surface when installed. This can enable a wallcovering WC, in FIG. 5, such as paint, coating, wallpaper, drywall, film or other material to be placed over the distal end without forming a substantially noticeable line or edge at that location. Generally, the first sealer wall 550 can taper (not shown) toward the distal end 552 of that first sealer wall 50 as described below. As an example of this tapering, the first sealer wall 50 can taper from the first thickness T1 to a lesser second thickness generally toward the distal end 552.

The base 540 can include a lower surface 540L configured to face toward a first surface 1 of a first building structure. For example, as shown in FIG. 4, the surface 540L can be configured to face toward a building wall W upper portion or surface 1 and contact that first surface 1 directly when the structural barrier 510 is placed within the gap G. The base 540 can include the upper surface 540U that can be configured to face toward the reference line RL and the second panel 530. The second panel can include an upper surface 530U and lower surface 530L, which faces generally toward the compartment 590C and the upper surface 540U. The upper surface 530U can be configured to face toward a second surface 2, for example a horizontal surface, such as a building ceiling C as shown in FIG. 4. Indeed, the respective surfaces and walls can engage the respective surfaces 1 and 2 as described below.

As shown in FIG. 1, the base 540 optionally can extend a distance D1 parallel to the reference line RL away from the first sealer wall 550. For this distance, the upper surface 540U and the base 540 can be generally parallel to the reference line RL. This distance D1 can optionally be at least ¼ inch, at least ½ inch, about 0.555 inch, at least 1 inch, at least 1.5 inch, at least 3 inches, at least 5 inches, or greater depending on the application.

The first panel 520 can include a first or proximal end 521 and a second or distal end 522. Likewise the second panel 530 can include a first or proximal end 531 and a second or distal end 532. The proximal end of the first panel 521 can be joined with the proximal end 531 of the second panel directly or indirectly. As shown in FIG. 1, the proximal end 521 can join directly with a transition wall or panel 560, and the proximal end 531 also can be joined to this common transition wall 560 at an upper end thereof. Optionally, the transition wall 560 can extend vertically and transversely to the horizontal reference line or plane RL, and can join the first panel and the second panel. This transition wall 560 can be linear, flat and/or planar as shown, or in some cases can take on an arcuate shape or curvature which extends through the plane RL. Further optionally, the transition wall can be of a different shape than the first and second panels, for example, generally linear or planar, while the first and second panels can be generally arcuate or include a curvature.

As shown in FIGS. 1 and 2, the base 540 can extend to the first panel 520. The first panel can be curvilinear and can transition on a curve C1 that is convex away from the horizontal reference line or plane RL, as it extends toward the second panel 530. The curve C1 can be constant or variable. In some cases, the curve can actually be a right angle, with the base 540 transitioning to the first panel 520 at a corner or right angle. In such a case, the base can be parallel to the reference line RL, while the first panel can be transverse or perpendicular to the reference line RL. The first panel can be flat and planar and can extend vertically upward from its distal end 522.

As mentioned above and shown in FIG. 1, the structural barrier 510 can include a reference plane or line RL that bisects the core compartment 590C or the structural barrier 510 into upper U and lower L portions, having corresponding heights H1 and H2. As shown, the structural barrier 510 can be of a slightly asymmetric configuration about the reference line RL. For example, the first 520 and second 530 panels can both be curved convexly away from the reference line, however, the curvatures C1 and C2 can be different and can have different length radii R1 and R2 respectively.

Optionally, the radius of curvature R2 of the second panel 530 can be greater than the radius or curvature R1 of the first panel 520. The second panel 530 can have a curvature C2 or curvilinear contour that is upwardly convex. The second panel 530 also can be flexible so the second panel can move toward or away from the horizontal reference line or plane RL to automatically adjust a height of the barrier relative to a gap between structural members within which the barrier is placed. The second radius R2 of the curvature or curvilinear contour C2 can be constant or variable. In some cases, it can be constant. Where constant, the radius R2 can be optionally about 0.1 inch to about 1.5 inches, about 0.2 inches to about 0.8 inches, about 0.2 inches to about 0.6 inches, or about 0.3 inches to about 0.4 inches.

Each of the first and second panels also can extend to their respective distal ends 522 and 532 about the same vertical distance from the reference line RL. Optionally, these ends 522 and 532 can be separated from one another by an overall height H1 plus H2, which can be less than, equal to or greater than the gap G within which the structural barrier 510 is to be placed. In some cases, the overall height H1 plus H2 can be slightly greater than the gap G so that the second panel 530 is resiliently compressed such that the wiper end 537 and distal end 532 of the second panel auto adjusts to varying height along the gap G when the barrier is placed. The overall height H1 plus H2 can be any height, depending on the gap to be filled, but can be optionally about ¼ inch, ½ inch, ⅔ inch, ¾ inch, 0.755 inch, 1 inch, 2, inches, 3 inches, 4 inches or other heights. Again, due to the flexibility of the second panel 530 and the compressibility of the core 590 when included, the barrier can accommodate a variety of different sized and varying gaps.

Optionally, the thickness T1 of the base 540, the first panel 520, and the second panel 530, and the optional transition wall 560 can be substantially equal. In some cases, this thickness T1 can be optionally 0.01 inches to 0.25 inches, inclusive, about 0.05 inches, 0.10 inches to 0.2 inches, inclusive, or 0.05 inches to 0.125 inches. As mentioned above, the thickness in some cases can taper or change, depending on the application.

With reference to FIGS. 1 and 2, the second panel 530 can taper or curve or angle away from the reference line RL while extending a distance D2 to a distal end 532 of that panel. The distance D2 can be greater than the distance D1 mentioned above. The second panel 530 can be arcuate, curved or arched generally upward, and convex away from the reference line RL. In other embodiments, the second panel 530 can be angled at a variety of steps upward and away from the reference line, depending on the application. With this curvature or angling of the second panel 530 away from the reference line RL, this panel can be resilient, bendable and flexible so that its distal end 532, when placed against a surface, such as a second surface 2, can bend, flex, fold or move (collectively move herein), in a general direction M toward the reference line RL, yet maintain the distal end 532 in contact with the horizontal surface 2 as described below. In some cases, the height H1 can be reduced substantially, to less than half H1 as shown.

As shown in FIG. 1, the second panel 530 can extend to its distal end 532. The second panel 530 can extend to the wiper end 537 that terminates generally above the first sealer wall 550 and above the horizontal reference line RL. The wiper end and in particular the upper surface 530L of the second panel can be optionally void of ribs or barbs as described above. As shown, the upper surface can be curvilinear and smooth, without any such ribs or projections. This in turn can reduce the weight of this wiper end so that when exposed to excess heat or fire, that wiper end will not sag to open the gap within which the barrier is placed. Without ribs, the upper surface of the second panel and barrier in general also can be less likely to vent smoke along or past the barrier 510.

The second panel 530 and/or the wiper end 537 can include an optional first or upper wedge 581. This upper wedge can extend downward from the wiper end of the second panel toward the lower wedge 582. The upper wedge 581 can include an exterior wedge wall 581A extending between an outer edge 537E of the wiper end 537 and an apex 581P of the upper wedge, toward the open face 589. The wall 581A can be a curvilinear recess, optionally concave. The wedge 581 can further include a second or inner wall 581B that faces generally toward the second and first panels, or generally toward the reference line or plane RL. The inner wall optionally can be planar or flat, or can in some cases mimic the exterior wall but be faced opposite from it.

Optionally, the upper wedge can be smaller in size than shown, or absent from the second panel and/or wiper end. With the upper wedge being smaller, this can reduce the weight of the wiper end so that when exposed to excess heat or fire, that wiper end will not sag to open the gap within which the barrier is placed. Further optionally, although shown as a true wedge with walls tapering to an apex or thinning, the upper wedge also can be in the form of a uniform thickness wall, or a reverse wedge yet still referred to as a wedge herein.

The upper wedge 581 can extend downward toward the lower wedge 582, with the wedges defining the open face 589 therebetween. This open face, as mentioned above, can offer a view to a user to the core compartment 590C and a core 590 disposed therein. This view can afford the viewer a visual confirmation that the core is indeed included in the barrier 510, offering a suitable level of fire, smoke, noise or other suppression.

The core compartment 590C as shown can be bounded by the lower wedge 582, the first panel 520, the transition panel 560, the second panel 530 and the upper wedge 581. Of course, where one of these walls, wedges or panels are missing, the compartment 590C can be bounded by fewer or more walls or panels. Again, the open face 589 defined above the lower wedge and below the lower wedge when included, can offer the view into the core compartment to assess or confirm its contents.

As mentioned above and shown in FIG. 1, the core compartment 590C can contain the core 590. This core can be of an elongated construction and can extend along the length L of the base or barrier in general, from one end to the other. The core can include an exposed surface 590E that is exposed to a viewer through the open face 589 when the barrier is installed relative to first and second structural members as described below. The core 590 can be of a bright color, such as red, neon and orange, to aid in inspection and confirmation of its presence. The core can be formed to match the interior surfaces of the core compartment to provide exceptional fitment and retention in the core compartment when the barrier 510 is installed. In some cases, the core can be of a uniform density throughout its cross section, while in others, the density can vary.

The core 590 can include multiple surfaces and features that directly engage the components of the barrier 510. For example, the core can include a lower wedge surface 592 that engages the lower wedge 582 and an upper wedge surface 591 that engages the upper wedge 581. These surfaces can expand against the respective wedges when the core expands due to heat as described below. The respective upper wedge and the lower wedge can exert an opposing force F1 and F2 respectively on the expanding core to retain the core in the core compartment when subjected to heat or fire. Optionally, the core also can include a second panel surface 593 that engages the second panel 530. This surface and the core material near it can compress in some cases more than other parts of the core when the barrier is placed in a gap G, due to the second panel 530 flexing or bending in direction M to accommodate the dimensions of the gap. Further optionally, the core can include a transition surface 593 that engages the transition wall 540, a first panel surface 597 that engages the first panel 520 and a base surface 598 that engages the base 540. Of course, in some applications, the core might not match the interior surfaces of the respective panels and walls of the barrier. In such a case, the core might be of a polygonal, round or elliptical cross section and simply placed in the core compartment, without matching its internal shape and dimensions.

As mentioned above, the elongated core can be constructed from a variety of materials. The materials can be in the form of a fire retardant, sound deadening, sound reducing, and/or cushion element. In some cases, the core can be precut and shaped to fit inside the core compartment. In other cases, the core can be sprayed or otherwise filled within the core compartment 590C within all the panels. The core can be compressible, such that when the second panel moves in direction M, when the barrier is placed in a gap, the core can compress. In some cases, the core can be constructed from a foam, a polymer, natural fibers, a gel, a viscous material, or combinations of any of the foregoing. As shown, the core can be constructed from an intumescent foam that swells due to exposure to heat. Such a core can increase in volume and decrease in density when exposed to heat, for example, heat due to fire or flames, optionally above 200 degrees, above 300 degrees, above 400 degrees, above 500 degrees, above 1000 degrees or other temperatures Fahrenheit. When the core swells, the wedge surfaces thereof expand outward, against the lower wedge and the upper wedge, which cooperatively retain the core within the core compartment when the core swells. Again, this can be due to the wedges exerting the dynamic and reactive forces F1 and F2 against the core. The panels and walls surrounding the core also can cooperate to contain the core within the core compartment and the barrier 510 in general. In some cases, the core can swell or expand or bulge through the open face 589. After extended exposure to heat or flames, the core can begin to disintegrate, and the barrier itself can melt or burn.

A method of installing the structural barrier will now be described with reference to FIGS. 3-5. The structural barrier can be installed between a first building structure W and a second building structure C. The first building structure W optionally can be a vertical wall or vertical surface having a vertical third surface or outer surface 3. The second building structure C optionally can be a ceiling or horizontal surface having a second surface 2. The wall W also can include a first surface 1 that is formed in an upper portion of the wall W. The gap G can be formed vertically between the first surface 1 and the second surface 2.

Figure 3:
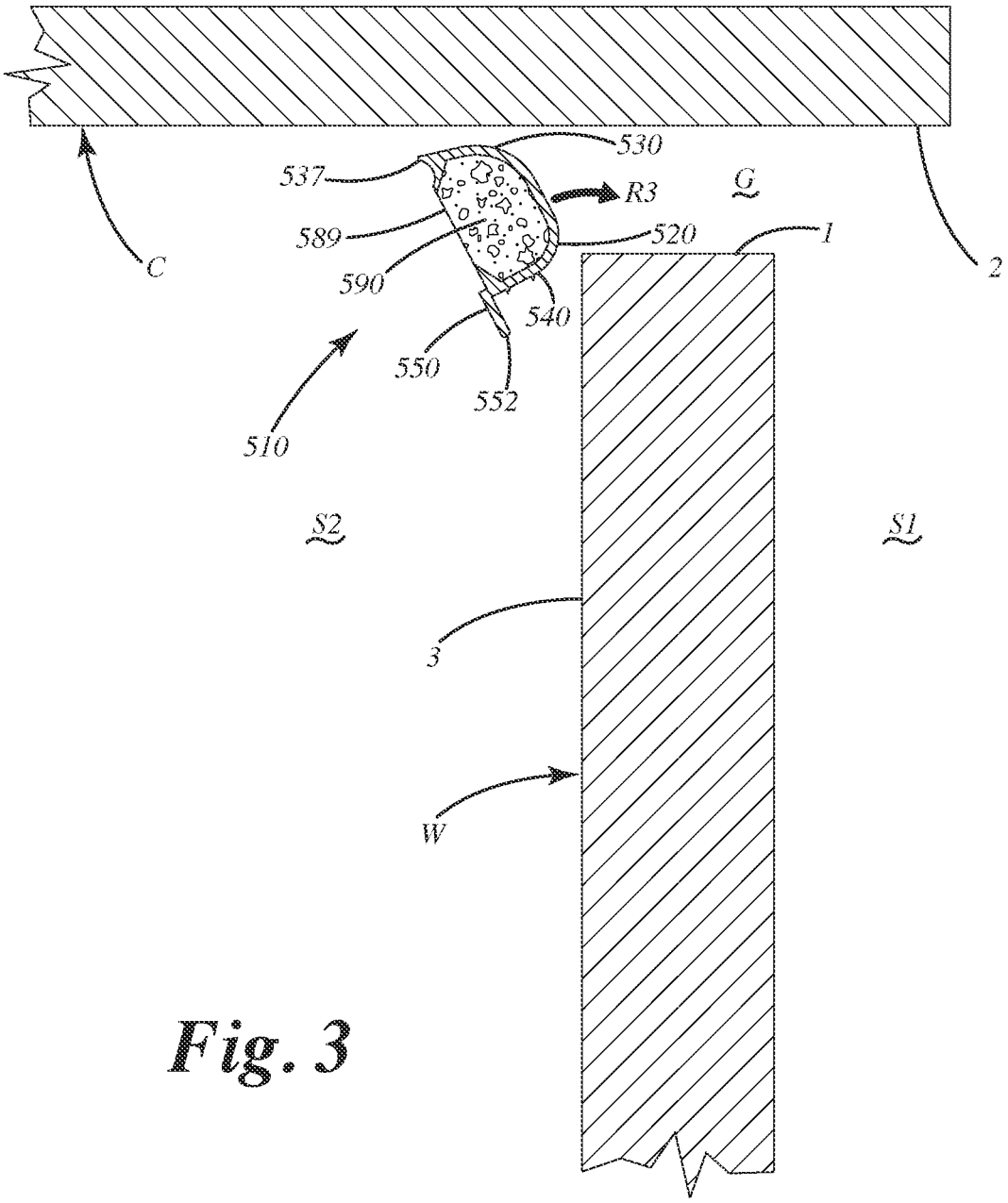
FIG. 3 is a section view of the structural barrier being initially installed in a gap between adjacent building structures.

The structural barrier 510 in FIG. 3 can be tilted in direction R3 and inserted into the gap G. Upon the insertion, the sealer wall 550 can engage the third surface 3. The first sealer wall 550 can remain rigid or slightly flex upon such engagement. The first sealer wall 550 can extend downward and transversely from the base 540 against a third surface 3 of the building that is substantially perpendicular to the first surface with the first sealer wall at least impairing the first and second panels from being inserted too far into the gap between the first and second surfaces.

The base 540 and/or first panel 520 can engage the first surface 1. The wiper end 537 and/or the second panel 530 can engage the second surface 2 of the ceiling C. As a result, the second panel 530 can resiliently deflect and/or slightly bend upon such engagement. The second panel 530 can move in direction M, bending or flexing automatically, downward toward the base, with the second panel bending along an arcuate contour toward the base. The overall height H1 plus H2 of the barrier 510 can automatically adjust to allow the barrier to fit within the gap G between the first surface 1 and the second surface 2. In so doing, the second panel can optionally change from the arcuate shape as shown to a less arcuate or more bent shape. The first and second wedges can also be disposed in the gap, and again the sealer wall does not enter the gap, but rests against the wall 3. The wiper end also can move in direction M as the barrier is inserted. During this insertion, the core is compressed, and decreases in volume, and optionally increases in density within the core compartment, with the various interior surfaces pushing against the core surfaces. The wedges can further act to retain the core in the compartment.

As shown in FIG. 4, the structural barrier 510 can be almost fully installed in the gap G. In this configuration, the second panel 530 and wiper end 537 can be flexed to accommodate different dimensions of the gap along the gap length. The overall height H1 plus H2 of the barrier can be reduced to a second, lesser height H1. The U-shaped core compartment 590C also can compress and close slightly. The first sealer wall 550 can engage and continue to engage the third surface 3. Generally, the first sealer wall, which can extend transversely from the first extension wall, can be placed against the third surface 3 which again is substantially perpendicular to the first surface 1 of the wall. The wiper end and second panel can be placed against and exert a force F3 on the surface 2 of the ceiling, which exerts a reactive and corresponding force F4. When the structural barrier 10 is pushed into the gap G, the base and panels can compress toward one another and toward the reference line RL. Again, as the structural barrier 510 is inserted into the gap G, the first sealer wall 550 can impair the first and second panels and base from being inserted too far into the gap G between the first and second surfaces.

With reference to FIG. 5, the structural barrier 510 can be fully installed. There, the structural barrier 510 optionally can be adhered in place with an adhesive A that is applied to the respective surfaces of the base, first panel and second panel. This adhesive A can secure the base and part of the first panel 520 to the first surface 1, the first sealer wall 550 to the third surface 3 and the second panel and wiper end to the second surface 2. In this configuration, the open face 589 can be initially open so that the core 590 is viewable to an inspector or other viewer to confirm its presence and placement.

Optionally, a wallcovering WC can be applied to the respective surfaces 2 and 3 of the wall W and ceiling C. The wallcovering WC also can extend over portions of the wiper end as well as the first sealer wall 550. A filler material, optionally plaster, drywall, spackle or other material, can be installed over parts of the barrier 510. The wallcovering WC also can extend over the filler material. Of course, in other applications, the filler material might not be installed such that there is a small groove at the top of the wall.

With the structural barrier 510 installed in the gap G, it can provide sound deadening between the different spaces 51 and 52 on opposite sides of the building structure W. The structural barrier also can inhibit, prevent or impair spread of fire between those spaces 51 and 52. Further, the structural barrier can prevent debris, materials, matter or other things from being transmitted or transferred from the first space 51 to the second space 52.

Figure 6:
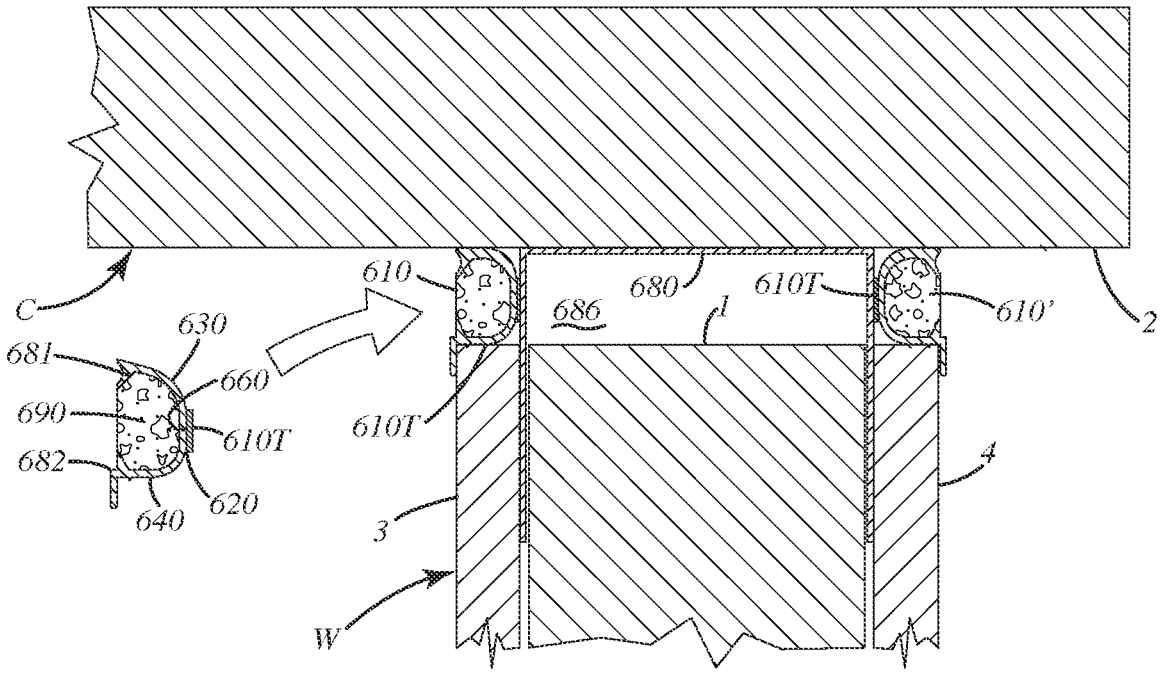
FIG. 6 is a section view of duplicate structural barriers of a first alternative embodiment installed in a gap.

A first alternative embodiment of the structural barrier is shown in FIG. 6 and generally designated 610. The structural barrier can be virtually identical to the structural barrier 510 described above in structure, function and operation with a few exceptions. For example, the structural barrier 610 can include a base 640, first panel 620 and a second panel 630 with wedges 681 and 682 to retain a core 690 in a core compartment 690C. In this embodiment, the barrier can also include a double sided tape 610T. This tape 610T can be used to secure the first panel 620, transition panel 660 and/or second panel 630 to a bracket 680. A filler strip 686 can be disposed above the wall in the bracket 680. This filler strip can be a fire barrier or intumescent foam located between the first surface 1 of the wall and the second surface 2 of the ceiling. Further, in this embodiment, another or second barrier 610 can be disposed on the other side of the strip 6 adjacent another surface 4 of the wall W, opposite the first wall surface 3. The duplicate barriers can provide enhanced fire protection, prevent or impair fire spread and reduce noise.

Figure 7:
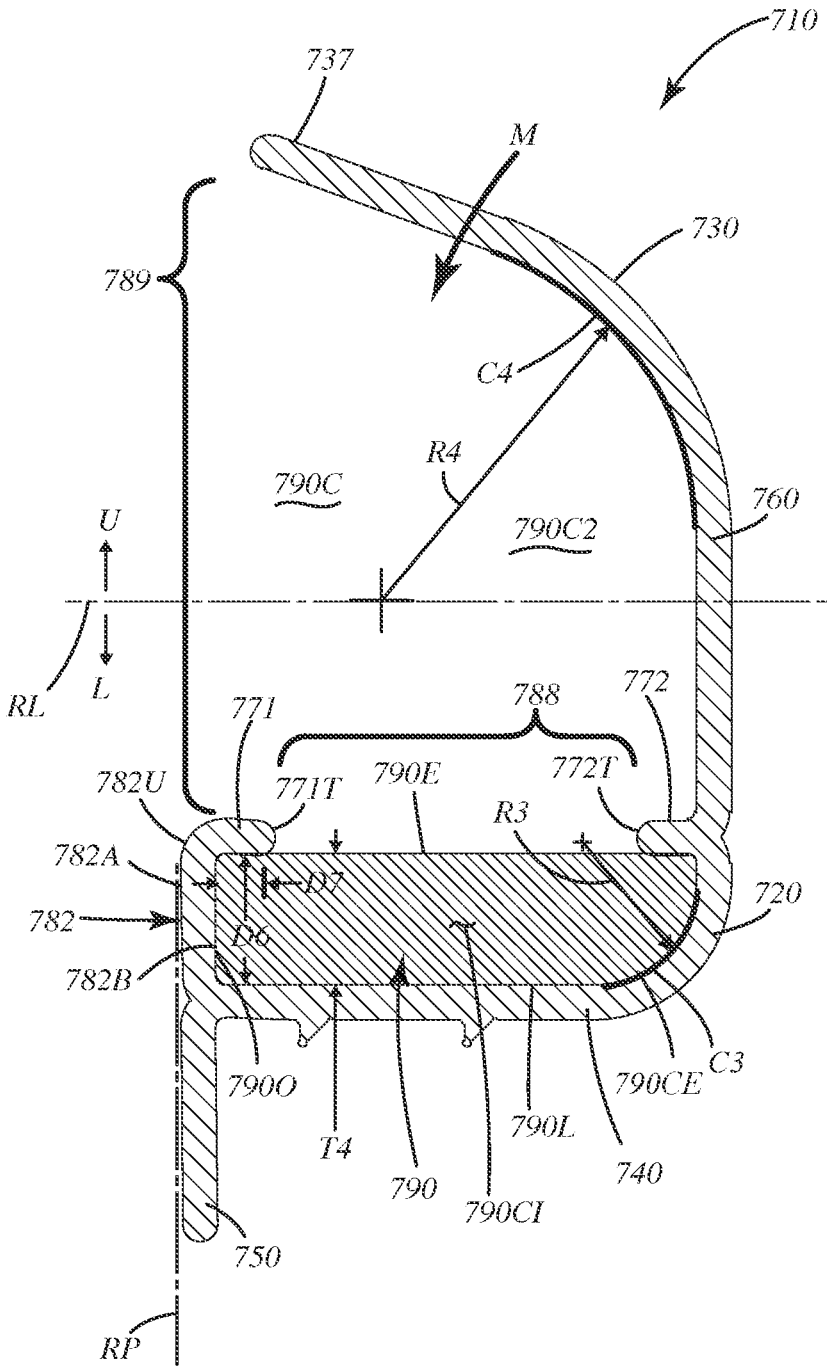
FIG. 7 is a section view of a second alternative embodiment of the structural barrier including a reduced volume core before blooming thereof.
Figure 8:
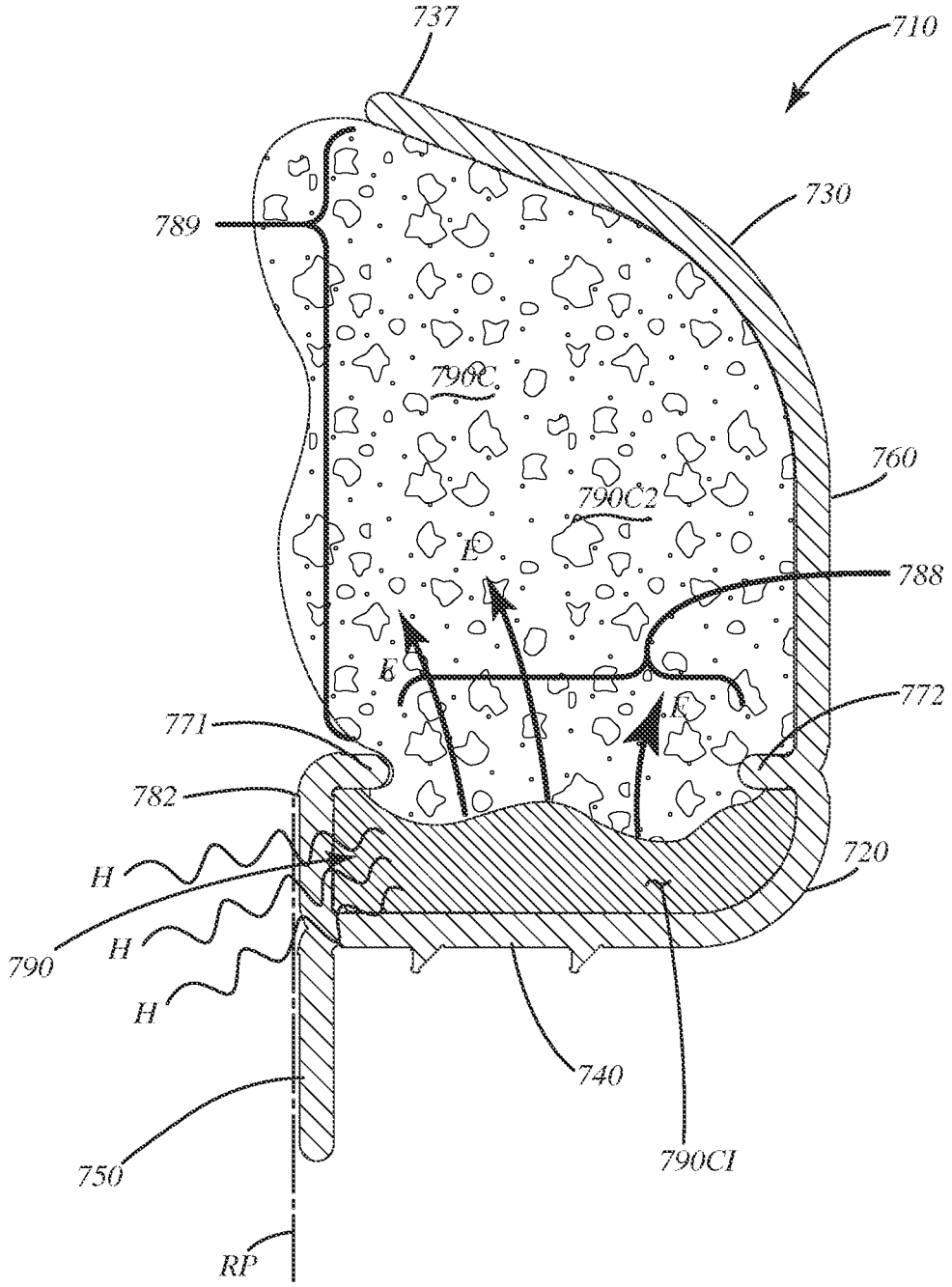
FIG. 8 is a section view of the second alternative embodiment of the structural barrier where the core is blooming.
Figure 9:
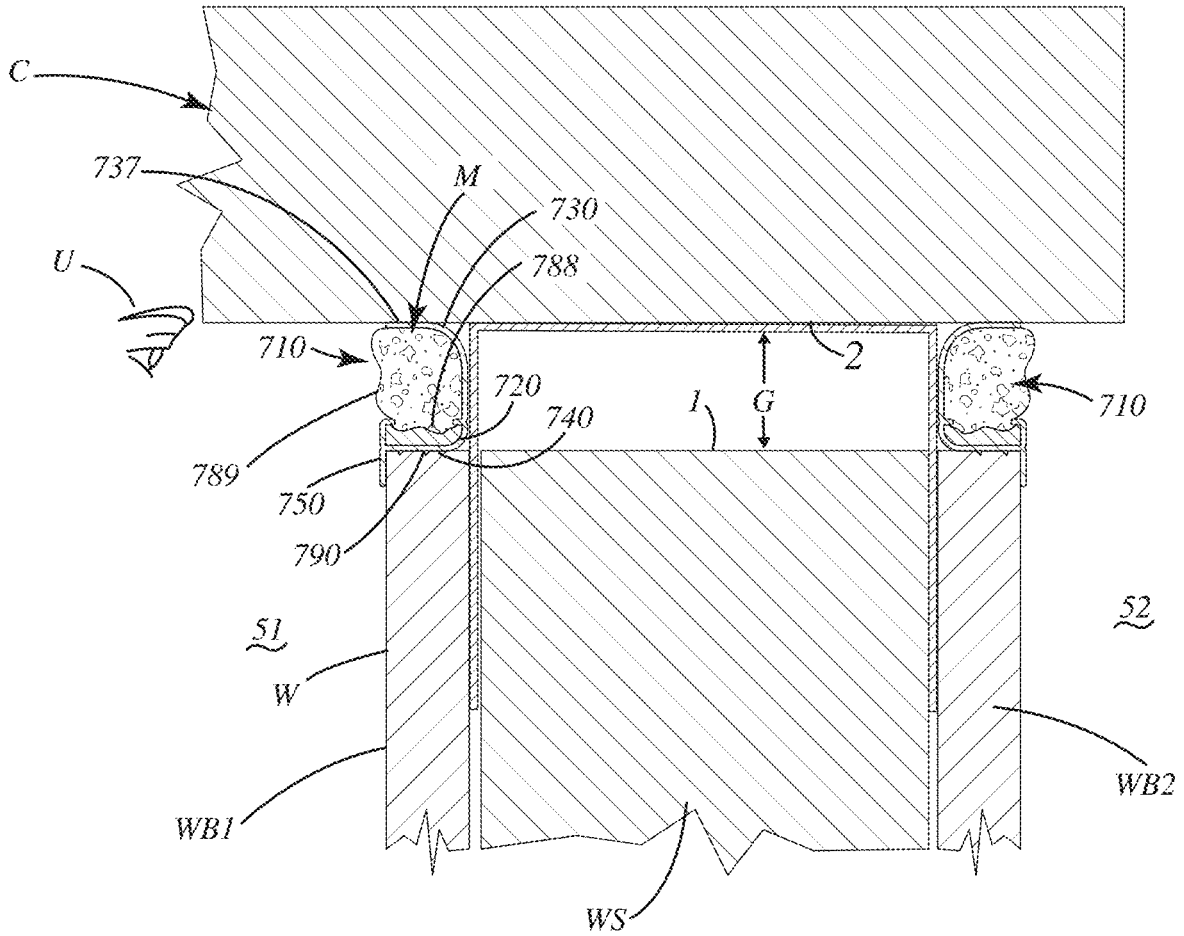
FIG. 9 is a section view of duplicate structural barriers of the second alternative embodiment installed in a gap.

A second alternative embodiment of the structural barrier is shown in FIGs. 7-9 and generally designated 710. The structural barrier 710 can be virtually identical or similar to the structural barrier 510 and 610, as well as any other embodiments herein described above in structure, function and operation with a few exceptions. For example, the structural barrier 710 can include a base 740, first panel 720 and a second panel 730 with one or more wedges 781 to retain a core 790 in a core compartment 790C. The first panel 720 and second panel 730 can be joined via a transition wall 760. The first panel 720 can extend to a base or extension wall 740 which itself can transition to the first sealer wall 750. The second panel 730 can terminate at a distal free end 737 which extends in a cantilevered manner over the base and wedge 782 described below. The second panel can be disposed above the first panel 720, transition wall 760, extension wall 740 and first sealer wall 750. With the exception of the free end, all of these components can be virtually identical to those of the embodiments above. The free end and second panel can be configured to move in direction M such as when the barrier 710 is forced into a gap between structural members, optionally under force.

As shown in FIG. 7, like the embodiment above, the base 740 can extend to the first panel 720. The first panel can be curvilinear and can transition on a curve C3 that is convex away from the horizontal reference line or plane RL, as it extends toward the second panel 730. The curve C3 can be constant or variable. In some cases, the curve can actually be a right angle, with the base 740 transitioning to the first panel 720 at a corner or right angle. In such a case, the base can be parallel to the reference line RL, while the first panel can be transverse or perpendicular to the reference line RL. The first panel can be flat and planar and can extend vertically upward from its distal end toward the transition wall, or the second panel 730.

Like the embodiments above, the first 720 and second 730 panels can both be curved convexly away from the reference line, however, the curvatures C3 and C4 can be different and can have respective different length radii R3 and R4. Optionally, the radius of curvature R2 of the second panel 730 can be greater than the radius of curvature R3 of the first panel 720. The second panel 730 can have a curvature C4 or curvilinear contour that is upwardly convex. The second panel 730 also can be flexible so the second panel can move toward or away from the horizontal reference line or plane RL to automatically adjust a height of the barrier 710 relative to a gap G between structural members within which the barrier is placed. The second radius R4 of the curvature or curvilinear contour C4 can be constant or variable. In some cases, it can be constant. Where constant, the radius R4 can be optionally about 0.1 inch to about 2 inches, about 0.1 inch to about 1.5 inches, about 0.2 inches to about 0.8 inches, about 0.2 inches to about 0.6 inches, or about 0.3 inches to about 0.4 inches.

As shown in FIG. 9, one or more structural barriers 710 can be disposed between a first building surface 1 and a second building surface 2 to fill in, occlude, or partially or fully obstruct a gap G between the first surface 1 and the second surface 2, virtually identically to the barriers of the embodiments described above. As shown, the first surface 1 can be an upper portion of a wall W, and the second building surface 2 can be a horizontal surface, such as that of a ceiling or a roof or other generally horizontal structure C in a building. Of course, in other applications as described below, the gap G can be formed between other building surfaces.

In this second embodiment, however, the one or more wedges, core and core compartment can differ somewhat from the embodiments above. For example, the barrier 710 can be equipped with one or more wedges, such as a first or lower wedge 782 that projects from the base 740 at or near the first sealer wall 750. The distal free end 737 can be void of any such wedge. The open face 789 can be defined between the wedge 782 and the distal free end 737. Through this face the fire resistant core 790 can be visible to confirm via a visible inspection its presence in the barrier 710. The open face design with the core also allows the distal end 737 to flex toward the wedge 782 when the core compresses under forces as described below, which in turn allows for significant variance in gap widths in which the barrier can be used.

The wedge 782 in this embodiment can be similar to and also can differ from the lower wedge of the embodiment above. For example, this wedge 782 can include an exterior wall 782A and an interior wall 782B, which can face toward the first panel 720. The interior and exterior walls can be generally planar and parallel to one another. Although referred to as a wedge, this element 782 might not in some cases perform an actual wedging action of functionality, and may be in the form of a wall. In some cases, the exterior wall 782A can be aligned in parallel to and generally flush with an exterior surface of the first sealer wall 750. The exterior surfaces of these walls can lay in a common reference plane RP. The interior wall 782B can be disposed opposite the curvature C3 and the uppermost extent of the first panel 720. Optionally, as shown, the wedge 782 can extend upward, away from the base 740 a distance D6 that is about equal to a location where the curvature C3 on the first panel 720 ends. Of course, in other applications, that distance D6 can be altered. Further, this distance D6 can be less than, equal to or slightly greater than a thickness T4 of the core 790 as described below.

Optionally, the wedge 782 can extend upward to an upper end 782U which can be optionally located below the reference line RL and the lower portion L of the barrier 710. The upper end 782 can include or otherwise be joined with a first lower flange 771 that projects generally toward the first panel 720 and/or the transition panel 760. This flange can be parallel to the base 740 and can project a distance D7 inward toward the panels 720 and/or 760. This distance D7 can optionally be 0.1 inches, at least 0.25 inches, or some other measurement depending on the application. The lower first flange 771 can end at a tip 771T. This tip can be disposed over an upper surface or exposed surface 790E of the core 790 when the core is disposed in the core compartment 790C, and in particular the first cavity 790C1 of the core compartment 790C.

As shown in FIG. 7, the lower first flange can be joined with the first wedge 782 and can generally segment the core compartment 790 C into the above-mentioned first cavity 790C1 and a second cavity 790C2. The first cavity as shown can have a smaller volume and/or area than the second cavity. The first cavity can make up a minority of the space of the core compartment, while the second cavity can make up a majority of the space of the core compartment. Generally, the first cavity 790C1 can be located below the reference line RL, and the lower portion of the barrier 710. The first cavity also can be disposed below the first lower flange 771 and its tip 771T. This lower first cavity can be sized to accommodate the core 790, which can be identical to the core described in the embodiments above except for its general configuration.

Optionally, the core 790 can be constructed from the same materials as those described above, in some applications an intumescent foam. That foam, like that described above, can increase in volume and decrease in density when exposed to heat, for example, heat generated via fire and/or flames. Again the core can be constructed so that the core swells due to exposure to heat as with the embodiments above.

The core 790 in this embodiment as shown in FIG. 7, however, can be a generally rectangular and/or polygonal construction that fits easily within the first cavity. The innermost corner edge 790CE can be rounded or contoured to match the curvature C3 and fit against the first panel, optionally directly engaging that first panel along the curvature C3. The lower surface of the core 790L can engage the base 740 and the outer surface 790O can engage the interior wall 782B. The upper surface 790E can face upward and can be visible through the open face 789 of the barrier 710. As shown in FIG. 7, the exterior 790E of the core 790C can be visible through a bloom gap 788 that is disposed adjacent the lower first flange 771, in particular, beginning at its tip 771T. A user U shown in FIG. 9 thus can view the presence of the core 790 in the barrier 710 installed between the surfaces 1 and 2 through the open face 789 and through the bloom gap 788, as described below. In this manner, the user can confirm the presence of that core in the fire barrier in certain applications.

Optionally, the bloom gap 788 also can be bounded by a lower second flange 772 that extends toward the open face and/or lower wedge 782. This lower second flange 772 can be aligned with and in a common plane with the lower first flange 771. This lower second flange 772 can terminate at a tip 772T which can be distal from the first tip 771T. This second flange can project from the upper portion of the first panel 720 and/or the lower portion of the transition panel 760 as shown. In other applications, this flange 772 can project from the first panel 720 by itself or from the transition panel 760 by itself.

Generally, this lower second flange 772 can be disposed above the first cavity 790C1 and below the second cavity 790C2. This second flange 772 can project outwardly away from the first panel 720 and/or the transition panel 760 a distance similar to distance D7 so that the flange 772 projects over the exterior surface 790E of the core 790. Where both the first and second lower flanges 771, 772 project over the core when it is installed, these elements can secure the core 790 within the first cavity 790C1. The first and second flanges can cooperatively form the bloom gap 788 therebetween. Where the second flange 772 is not present, the bloom gap can be formed between the first lower flange 771 and the first panel 720 and/or the transition panel 760. Further, although the first and second lower flanges are shown as projecting the distance D7 outwardly over the intumescent core, this distance D7 can vary and can be offset toward or away from the first panel and transition panel, depending on the application and an intended trajectory of the core 790 when it blooms and expands outward from the body of the core. In addition, the first and second flanges can be stepped or vertically offset from one another although shown on the same plane, over the first cavity.

With reference to FIG. 8, the swelling and expansion of the core 790 within the barrier 710 is illustrated. There, the core 790 can be constructed from an intumescent foam that swells due to exposure to heat H, for example created by a fire. When so exposed to heat, that foam will begin to expand and swell. As it does, the foam can bloom outward and in directions E, generally traversing through the bloom gap 788 defined between the lower flanges 771 and 772, or simply between the wedge 782 and the panels 720 or 760, when the flanges are not included. As this occurs, the foam material begins to engage the upper surfaces of the lower flanges, as well as the transition panel 760 where included, and the upper panel 730. The foam can continue to expand outward through the open face 789 as shown in some applications. In so doing, it can pass beyond the reference plane RP of the first sealer wall 750 and/or the wedge 782. It also can pass beyond the free end 737 of the barrier 710. As will be appreciated, when the core swells and expands, it escapes through the bloom gap into the second cavity 790C2, moving upward therethrough and optionally filling the entire compartment 790C. With reference to FIG. 9, when this occurs, the gap G, which is between the first surface 1 and the second surface 2, for example, between a wall and a ceiling, can be filled with a fire retardant material, that is the swollen intumescent material. That material can continue to burn for a predetermined amount of time or until the fire or heat is suppressed or subsides. In this manner, the fire can be restricted from spreading via the barrier 710 from one space 51 on one side of the wall to another space 52 on the other side of the wall.

In use, the method of installing the structural barrier 710 of this embodiment is similar and virtually identical to that of the embodiment described above, so the method will not be described in much detail here. Generally, with reference to FIG. 9, opposing structural barriers 710 can be installed within a gap G. The barriers 710 can be disposed on opposite sides of the gap G over wall boards WB1 and WB2 that are adjacent a steel stud WS. The barrier 710 can be pushed against the second surface 2 such that the second panel 730 and free end 737 can bend in direction M to accommodate the gap G. The first panel, which can form a portion of the base 740, can engage the first surface. The second panel 730 can engage the second surface above the first surface. The base also can extend away from the first panel. The first sealer wall 750 can extend downward and transversely from the base against a third surface of the building substantially perpendicular to the first surface. The first sealer wall 750 can optionally impair the first and second panels from being inserted too far into the gap G, in a manner similar to the embodiments above.

As mentioned above, the second panel 730 can be moved in direction M, optionally downward toward the base 740. In so doing, the second panel 730 can bend along an arcuate contour toward the base. In this way, the height of the barrier automatically adjusts to allow the barrier to fit within the gap G between the first surface and the second surface. A wallcovering can be applied over the first sealer wall so the first sealer wall melds into the third surface.

In this embodiment, the first wedge 782 can be provided along the base 740 such that the open face 789 is disposed above the first wedge 782. The first cavity 790C1 can be defined below the lower flange 771 extending from the wedge. Optionally, in other applications where the lower flange extends from the base and/or the first panel into the core compartment, the first cavity can be defined below that flange. A second cavity can be defined above the lower flange 771 and/or 772. The barrier 710 can be constructed so that an intumescent core 790 can be positioned within the first cavity 790C1 and/or generally in the core compartment 790C as with the embodiments above. The intumescent core can be retained within the first cavity at least partially by the lower flange and located adjacent the first wedge, the base and/or the first panel. The intumescent core can be positioned so that it can swell upward, through the bloom gap 788 defined adjacent the lower first and/or second lower flanges 771 and/or 772 when exposed to heat. In this manner, with reference to FIG. 8, and as mentioned above, the intumescent core can swell and move in direction E out from the first cavity and into the second cavity or generally expand throughout the core compartment to provide additional fire protection via the barrier 710.

The various components and features of the embodiments herein, for example, the structural barrier and its components, can take on a variety of aesthetic forms, shapes and sizes. Although a particular component or feature can have a function, that feature can be expressed in different aesthetic manners to form an artistic design and/or a purely ornamental design.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z, and/or any other possible combination together or alone of those elements, noting that the same is open ended and can include other elements.

What is claimed is:

1. An elongated structural barrier comprising:

a base;

a first panel extending upward from the base toward a horizontal reference line;

a first sealer wall extending downward and transversely to the base;

a second panel joined with the first panel and extending upwardly above the horizontal reference line in a curvilinear manner and having a radius of about 0.2 inches to about 0.6 inches, the second panel extending to a wiper end that terminates above the first sealer wall and the horizontal reference line;

a lower wedge extending upward from the base adjacent the first sealer wall, the wedge including a first wedge wall and a second wedge wall, the second wedge wall facing toward at least one of the first panel and the second panel; and a core compartment bounded by the lower wedge, the first panel, and the second panel, with an open face defined above the lower wedge and offering a view into the core compartment, the core compartment including a first cavity; and a lower flange projecting outward over the base and terminating at a lower flange tip that forms a boundary of a bloom gap over the first cavity, the lower flange and the lower flange tip being disposed above the first cavity.

2. The elongated structural barrier of claim 1, wherein the core is constructed from an intumescent material that swells due to exposure to heat;

whereby the core increases in volume and decreases in density such that the core swells against the first panel and the lower wedge, with the lower wedge retaining the core in the core compartment when the core increases in volume due to exposure to heat.

3. The elongated structural barrier of claim 2, wherein the first sealer wall extends downward from a first distal end of the base;

wherein the first sealer wall includes a first sealer wall inner surface configured to face toward a building wall outer surface.

4. The elongated structural barrier of claim 1, comprising:

a lower second flange joined with the first panel and extending toward the lower wedge;

wherein the core compartment includes a first cavity and a second cavity;

wherein the first cavity is below the lower second flange;

wherein the second cavity is above the lower second flange.

5. An elongated structural barrier comprising:

a base;

a first panel extending upward from the base toward a horizontal reference line;

a first sealer wall extending downward and transversely to the base;

a second panel joined with the first panel and extending upwardly above the horizontal reference line in a curvilinear manner and having a radius of about 0.2 inches to about 0.6 inches, the second panel extending to a wiper end that terminates above the first sealer wall and the horizontal reference line;

a lower wedge extending upward from the base adjacent the first sealer wall, the wedge including a first wedge wall and a second wedge wall, the second wedge wall facing toward at least one of the first panel and the second panel;

a core compartment bounded by the lower wedge, the first panel, and the second panel, with an open face defined above the lower wedge and offering a view into the core compartment; and a core disposed in the core compartment;

wherein the core is of an elongated construction and extends along a length of the base;

wherein the core compartment includes a first cavity and a second cavity;

wherein the lower wedge includes a lower first flange extending toward the first panel;

wherein the first cavity is below the lower first flange;

wherein the second cavity is above the lower first flange.

6. An elongated structural barrier comprising:

a base;

a first panel extending upward from the base toward a horizontal reference line;

a first sealer wall extending downward and transversely to the base;

a second panel joined with the first panel and extending upwardly above the horizontal reference line in a curvilinear manner and having a radius of about 0.2 inches to about 0.6 inches, the second panel extending to a wiper end that terminates above the first sealer wall and the horizontal reference line;

a lower wedge extending upward from the base adjacent the first sealer wall, the wedge including a first wedge wall and a second wedge wall, the second wedge wall facing toward at least one of the first panel and the second panel; and a core compartment bounded by the lower wedge, the first panel, and the second panel, with an open face defined above the lower wedge and offering a view into the core compartment;

wherein the wiper end includes an upper wedge having an exterior wedge wall extending between an outer edge of the wiper end and an apex of the upper wedge, toward the open face.

7. The elongated structural barrier of claim 6, comprising:

a core disposed in the core compartment, in the first cavity;

wherein the core is of an elongated construction and extends along a length of the base;

wherein the core is captured in the first cavity via the lower first flange and the lower second flange;

wherein the core is constructed from an intumescent material that swells due to exposure to heat against the lower first flange and the lower second flange;

wherein the lower first flange and the lower second flange define a bloom gap therebetween;

whereby the intumescent material swells through the gap and into the second cavity of the core compartment when the core swells.

8. An elongated structural barrier comprising:

a base;

a first panel extending upward from the base toward a horizontal reference line;

a first sealer wall extending downward and transversely to the base;

a second panel joined with the first panel and extending upwardly above the horizontal reference line;

a first wedge extending upward from the base adjacent the first sealer wall, the first wedge including a first wedge wall and a second wedge wall, the second wedge wall facing toward at least one of the first panel and the second panel; and a core compartment bounded by the lower wedge, the first panel, and the second panel, with an open face defined above the lower wedge and offering a view into the core compartment, wherein the core compartment includes a first cavity that is below a first flange that extends from the first wedge toward the first panel, wherein the core compartment includes a second cavity that is above the first flange.

9. The elongated structural barrier of claim 8, wherein the second panel extends upwardly along a curvilinear contour;

wherein the curvilinear contour includes a radius of about 0.2 inches to about 0.6 inches.

10. The elongated structural barrier of claim 9, wherein the curvilinear contour includes a radius of about 0.3 inches to about 0.4 inches;

wherein the first sealer wall extends downward away from the base and is configured to engage a vertical building surface.

11. The elongated structural barrier of claim 9, wherein the curvilinear contour is convex away from the horizontal reference line;

wherein the second panel extends to a wiper end that terminates above the first sealer wall and the horizontal reference line.

12. The elongated structural barrier of claim 8, wherein the second panel is flexible so the second panel can move toward or away from the horizontal reference line to automatically adjust a height of the barrier relative to a gap between structural members within which the barrier is placed.

13. The elongated structural barrier of claim 8, wherein the base is a planar wall that extends to the first panel;

wherein the first panel is curvilinear and transitions on a curve that is convex away from the horizontal reference line toward the second panel.

14. An elongated structural barrier comprising:

a base;

a first panel extending upward from the base toward a horizontal reference line;

a first sealer wall extending downward and transversely to the base;

a second panel joined with the first panel and extending upwardly above the horizontal reference line;

a first wedge extending upward from the base adjacent the first sealer wall, the first wedge including a first wedge wall and a second wedge wall, the second wedge wall facing toward at least one of the first panel and the second panel;

a core compartment bounded by the lower wedge, the first panel, and the second panel, with an open face defined above the lower wedge and offering a view into the core compartment;

an elongated foam core disposed in the core compartment;

a lower first flange extending from the first wedge; and a lower second flange extending from the first panel toward the lower first flange to establish a bloom gap therebetween;

wherein the core compartment includes a first cavity defined below the lower first flange and the lower second flange, and a second cavity above the lower first flange and the lower second flange;

wherein the elongated foam core is visible through the open face, and through the bloom gap, when the barrier is installed relative to first and second structural members.

15. The elongated structural barrier of claim 14, wherein the elongated foam core is constructed from an intumescent foam that swells due to exposure to heat, such that the foam swells through the bloom gap into the second cavity of the core compartment when the core swells.

16. An elongated structural barrier comprising:

a base;

a first panel extending upward from the base toward a horizontal reference line;

a first sealer wall extending downward and transversely to the base;

a second panel joined with the first panel and extending upwardly above the horizontal reference line;

a first wedge extending upward from the base adjacent the first sealer wall, the first wedge including a first wedge wall and a second wedge wall, the second wedge wall facing toward at least one of the first panel and the second panel;

a core compartment bounded by the lower wedge, the first panel, and the second panel, with an open face defined above the lower wedge and offering a view into the core compartment, an elongated foam core disposed in the core compartment;

a lower first flange extending from the first wedge above the base and inward into the core compartment so as to create a first cavity below the first flange and a second cavity above the first flange; and a lower second flange opposing the lower first flange to create a bloom gap therebetween, the second flange extending inward into the core compartment to create the first cavity below the second flange and the second cavity above the second flange, in cooperation with the first flange;

wherein the elongated foam core is disposed in the first cavity;

whereby the elongated foam core is positioned so that when the elongated foam core swells the elongated foam core projects into the second cavity travelling through the bloom gap.

17. The elongated structural barrier of claim 16, comprising:

an upper wedge extending downward from a wiper end of the second panel toward the lower wedge;

an intumescent core disposed in the core compartment, the intumescent core including a lower wedge surface that engages the lower wedge and an upper wedge surface that engages the upper wedge when the core expands due to heat;

whereby the upper wedge and the lower wedge exert an opposing force on the expanding core to retain the core in the core compartment.

18. A method of installing an elongated structural barrier, the method comprising:

placing an elongated structural barrier in a gap between a first surface and a second surface of a building such that a first panel and a second panel are within the gap, with the barrier engaging the first surface and the second panel engaging the second surface above the first surface, and such that a base extends away from the first panel;

placing a first sealer wall extending downward and transversely from the base against a third surface of the building that is substantially perpendicular to the first surface with the first sealer wall at least impairing the first and second panels from being inserted too far into the gap between the first and second surfaces;

moving the second panel downward toward the base, with the second panel bending along an arcuate contour toward the base, so that a height of the barrier automatically adjusts to allow the barrier to fit within the gap between the first surface and the second surface; and applying a wall covering to the first sealer wall so that the first sealer wall melds into the third surface, wherein an intumescent core is retained within the first cavity at least partially by the lower flange, and located adjacent the first wedge, the base and the first panel;

wherein the intumescent core is positioned so that the intumescent core swells upward through a bloom gap adjacent the lower flange when exposed to heat.

19. The method of claim 18 comprising:

providing a first wedge along the base such that an open face is defined above the first wedge, and a core compartment is bounded by the first wedge, the first panel, the second panel and the base;

defining a first cavity of the core compartment below a lower flange extending from at least one of the first wedge, the base, and the first panel into the core compartment; and defining a second cavity of the core compartment above the lower flange.

* * * * *